US011846290B2

(12) United States Patent
Todal

(10) Patent No.: US 11,846,290 B2
(45) Date of Patent: Dec. 19, 2023

(54) SYSTEM FOR PUMPING A FLUID AND METHOD FOR ITS OPERATION

(71) Applicant: FMC Kongsberg Subsea AS, Kongsberg (NO)

(72) Inventor: Karen Todal, Haslum (NO)

( * ) Notice: Subject to any disclaimer, the term of this patent is extended or adjusted under 35 U.S.C. 154(b) by 0 days.

(21) Appl. No.: 17/268,940

(22) PCT Filed: Aug. 12, 2019

(86) PCT No.: PCT/EP2019/071576
§ 371 (c)(1),
(2) Date: Feb. 16, 2021

(87) PCT Pub. No.: WO2020/035444
PCT Pub. Date: Feb. 20, 2020

(65) Prior Publication Data

US 2021/0340985 A1 Nov. 4, 2021

(30) Foreign Application Priority Data

Aug. 16, 2018 (NO) ..... 20181084

(51) Int. Cl.
*F04D 15/00* (2006.01)
*F04D 13/08* (2006.01)
*E21B 43/12* (2006.01)

(52) U.S. Cl.
CPC ..... *F04D 15/0005* (2013.01); *F04D 13/08* (2013.01); *F04D 15/0094* (2013.01); *E21B 43/128* (2013.01)

(58) Field of Classification Search
None
See application file for complete search history.

(56) References Cited

U.S. PATENT DOCUMENTS 4,699,570 A 10/1987 Bohn
6,663,349 B1 12/2003 Discenzo et al.
(Continued)

FOREIGN PATENT DOCUMENTS

WO WO 2016/041990 A1 3/2016
WO WO 2016/041991 A1 3/2016
(Continued)

*Primary Examiner* — Essama Omgba
*Assistant Examiner* — Geoffrey S Lee

(57) ABSTRACT

A method of operating a system (16) for pumping a fluid, which system comprises a pump (17) comprising a suction side (18) and a discharge side (19); a motor (20) for driving the pump, which motor is drivingly connected to the pump via a shaft; a recirculation conduit (23) providing a fluid path for the fluid from the discharge side to the suction side of the pump; and a control valve controlling the flow of the fluid through the recirculation conduit, which method comprises the steps of: mapping a plurality of minimum torque diagrams for the pump, where each minimum torque diagram identifies the minimum allowable torque of the pump as a function of an operational parameter of the pump, e.g. the differential pressure over the pump; from said plurality of minimum torque diagrams, identifying the minimum torque diagram best representing the current operation of the pump; monitoring said operational parameter of the pump and, from the minimum torque diagram best representing the current operation of the pump, identifying a minimum allowable torque value corresponding to a monitored value of said operational parameter of the pump, e.g. a monitored differential pressure value; monitoring the torque of the pump and comparing a monitored torque value with the identified minimum allowable torque value; and regulating the control valve such that the monitored torque value does not fall below the minimum allowable torque value. A corresponding pumping system is also disclosed.

11 Claims, 7 Drawing Sheets

(56) References Cited

U.S. PATENT DOCUMENTS

| | | | | |
|---|---|---|---|---|
| 7,117,120 | B2 * | 10/2006 | Beck | F04D 13/10 702/182 |
| 2004/0120804 | A1 * | 6/2004 | Sabini | F04D 15/0088 415/118 |
| 2016/0177958 | A1 * | 6/2016 | Schneider | F04D 15/0011 415/36 |
| 2017/0260982 | A1 * | 9/2017 | Grøtterud | F04B 49/03 |
| 2018/0313349 | A1 * | 11/2018 | Todal | F04B 49/106 |
| 2021/0164481 | A1 * | 6/2021 | Gassmann | F04D 27/0261 |

FOREIGN PATENT DOCUMENTS

| | | | | |
|---|---|---|---|---|
| WO | WO-2016041990 | A1 * | 3/2016 | F04D 13/08 |
| WO | WO 2017/076939 | A1 | 5/2017 | |
| WO | WO-2017076939 | A1 * | 5/2017 | F04B 15/00 |

* cited by examiner

SYSTEM FOR PUMPING A FLUID AND METHOD FOR ITS OPERATION

FIELD OF THE INVENTION

The present invention relates to a method of operating a system for pumping a fluid, which system comprises:

- a pump comprising a suction side and a discharge side,
- a motor for driving the pump, which motor is drivingly connected to the pump via a shaft,
- a recirculation conduit providing a fluid path for the fluid from the discharge side to the suction side, and
- a control valve controlling the flow of the fluid through the recirculation conduit.

The present invention also relates to a system for pumping a fluid, comprising:

- a pump comprising a suction side and a discharge side;
- a motor for driving the pump, which motor is drivingly connected to the pump via a shaft;
- a recirculation conduit providing a fluid path for the fluid from the discharge side to the suction side;
- a control valve controlling the flow of the fluid through the recirculation conduit;
- a first sensor device adapted to monitor an operational parameter of the pump; and
- a second sensor device adapted to monitor or estimate the torque of the pump.

In particular, the present invention relates to a method and a system for pumping a multi-phase fluid or a fluid having a variable density, e.g. a hydrocarbon fluid, in a subsea, topside or a land-based hydrocarbon production or processing facility or complex, e.g. in a hydrocarbon well complex, a hydrocarbon transport facility, or any other type of facility where hydrocarbons are handled.

BACKGROUND

In a hydrocarbon production facility or complex, multi-phase pumps are used to transport the untreated flow stream produced from hydrocarbon wells to downstream process or gathering facilities. This means that the pumps must be able to handle a hydrocarbon well or flow stream containing from 100 percent gas to 100 percent liquid. In addition to hydrocarbons, the flow stream can comprise other fluids, e.g. water, and solid particles, e.g. abrasives such as sand and dirt. Consequently, hydrocarbon multi-phase pumps need to be designed to operate under changing process conditions and must be able to handle fluids having varying gas-volume fractions (GVF) and/or densities.

In conventional multi-phase fluid pumping systems, one or a plurality of quantifiable system parameters are normally used to control one or a plurality of adjustable operating parameters of the system in order to keep the pump operating within a permissible operating region. The quantifiable system parameters may, for example, comprise a parameter indicative of the differential pressure across the pump, e.g. the pump suction pressure, and the adjustable operating parameters may, for example, comprise the rotational speed of the pump and/or a control valve setting controlling the flow of fluid through a recirculation conduit leading from the discharge side to the suction side of the pump.

The operational range of a pump is generally illustrated in a DP-Q diagram. In the DP-Q diagram, the differential pressure over the pump is mapped against the volumetric flow through the pump, and the permissible operating region within the DP-Q diagram is identified. The border between the permissible operating region and an impermissible operating region is defined a pump limit characteristics curve. Under normal conditions, the pump is operated only in the permissible operating region. However, if the pump enters the impermissible region, a pumping instability, or surge, may occur, in which case the pump may be subjected to a possible failure.

During operation of the system, the differential pressure across the pump and the flow of fluid through the pump may be monitored. If the monitored operating point approaches the pump limit characteristics curve, a recirculation loop, comprising a recirculation conduit leading from the discharge side to the suction side of the pump and a control valve controlling the flow of fluid through the recirculation conduit, may be activated, thereby securing a required minimum flow of fluid through the pump, thus keeping the pump operating in the permissible operating region of the DP-Q diagram.

However, due to the multi-phase character of the fluid flow in hydrocarbon production or processing systems, complex and expensive multi-phase flowmeters are normally required to monitor the flow of the fluid in a reliable way.

This is illustrated in FIG. 1, which shows a conventional pump limit characteristics DP-Q diagram 1 for a multiphase hydrocarbon pump where the differential pressure DP across the pump is mapped as a function of the volumetric flow Q through the pump. The diagram discloses a first pump limit characteristics curve 2 for a first gas volume fraction, GVF1, a second pump limit characteristics curve 3 for a second gas volume fraction, GVF2, and a third pump limit characteristics curve 4 for a third gas volume fraction, GVF3, of the hydrocarbon fluid, where GVF1<GVF2<GVF3. Each pump limit characteristics curve 2-4 comprises a minimum flow curve section 5, a minimum speed curve section 6 and a maximum speed curve section 7 defining a permissible operation region 8 and an impermissible operation region 9 of the pump. When the GVF is increased, it is necessary to increase the pump speed (and flow) in order to maintain the same torque. As is shown in the diagram 1, the operational point of the pump should be shifted when the gas volume fraction changes from GVF1 to GVF2 and then further to GVF3, as is indicated by the arrow 10.

In WO 2016/041990 A1 a system and a method are disclosed in which a multi-phase pump is regulated based on a minimum allowable torque instead of a minimum allowable flow, whereby costly multi-phase flowmeters can be avoided. In this system, a pump limit characteristics diagram is established by mapping a first system parameter, which is function of the differential pressure across the pump, as a function of a second system parameter, which is a function of the torque of the pump, identifying a permissible operating region of the pump. In operation, the differential pressure across the pump and the torque of the pump are monitored and the torque-based pump limit characteristics diagram is utilised to prevent the pump from entering an impermissible operating region. This makes measuring the flow through the pump redundant since sufficient flow through the pump is ensured as long as the pump torque is kept above a predefined minimum value identified by the torque-based pump limit characteristics diagram.

Such a pump limit characteristics diagram 11 is illustrated in FIG. 2, where the differential pressure across the pump, DP, is mapped as a function of the pump torque T. As stated above, this manner of establishing a pump limit characteristics diagram may be beneficial since it provides a way of protecting the pump without the need of installing costly multi-phase flowmeters in the pumping system. Instead of establishing pump limit characteristics curves for different GVFs or densities, only one pump limit characteristics curve 12 is established and stored in the pumping system. The pump limit characteristics curve 12 defines parameter values below which the pump may experience a pumping instability or surge, independent of the gas volume fraction and density of the fluid. The curve 12 separates a permissible operating region 13 from an impermissible operating region 14 of the pump.

Consequently, for every differential pressure value, $DP_0$, it is possible to identify an minimum allowable torque value, $T_0$, thus establishing a pump operation curve 15 in the permissible operating region 13 positioned at a predetermined, safe distance from the pump limit characteristics curve 12. Consequently, for each differential pressure value $DP_0$, the torque value $T_0$ may be used as a minimum allowable torque value.

In WO 2016/041990 A1 an initial assumption with regards to minimum torque protection was that selecting a minimum torque limit covering all flow conditions would not lead to significant loss of efficiency. However, it has been discovered that using the system and method according to WO 2016/041990 A1 may in some instances, depending of the range of operating conditions that the pump protection shall cover, unduly reduce the operating envelope of the pump, thus forcing unnecessary recirculation of fluid through the recirculation loop.

With the above problem in mind, one object of the present invention is to provide a system and a method which improves on the system and method disclosed in WO 2016/041990 A1.

Another object of the invention is to provide a system and a method having an improved minimum torque protection system as compared to prior art minimum torque protection systems.

SUMMARY OF THE INVENTION

According to one aspect, the invention relates to a method of operating a system for pumping a fluid, which system comprises:

- a pump comprising a suction side and a discharge side;
- a motor for driving the pump;
- a recirculation conduit providing a fluid path for the fluid from the discharge side to the suction side of the pump; and
- a control valve controlling the flow of the fluid through the recirculation conduit, which method comprises the steps of:

- mapping a plurality of minimum torque diagrams for the pump, where each minimum torque diagram identifies the minimum allowable torque of the pump as a function of an operational parameter of the pump;
- from said plurality of minimum torque diagrams, identifying the minimum torque diagram best representing the current operation of the pump;
- monitoring said operational parameter of the pump and, from the minimum torque diagram best representing the current operation of the pump, identifying a minimum allowable torque value corresponding to a value of said operational parameter of the pump;
- monitoring the torque of the pump and comparing a monitored torque value with the identified minimum allowable torque value; and
- regulating the control valve such that the monitored torque value does not fall below the minimum allowable torque value.

Said operational parameter of the pump may be the differential pressure over the pump, and said monitored value of said operational parameter of the pump may be a monitored differential pressure value of the pump.

Alternatively, said operational parameter of the pump may be the rotational speed of the pump, and said monitored value of said operational parameter of the pump may be a monitored rotational speed value of the pump.

Each minimum torque diagram may represent a unique combination of suction pressure and a rotational speed of the pump.

Each minimum torque diagram may define mapping points for a predetermined suction pressure value and a predetermined rotational value of the pump.

The step of mapping each minimum torque diagram may comprise the sub-step of:

- for the predetermined suction pressure value and the predetermined rotational speed value, defining said plurality of mapping points by mapping differential pressure over the pump as a function of torque of the pump for different gas-volume fraction values.

The step of mapping each minimum torque diagram may comprise the sub-step of:

- establishing a minimum torque curve from said mapping points by interpolating between the mapping points.

Said step of identifying the minimum torque diagram best corresponding to the current operation of the pump may comprise:

- monitoring suction pressure and rotational speed of the pump; and
- choosing the minimum torque diagram to represent the current operation of the pump based on the monitored suction pressure and torque.

Said step of choosing the minimum torque diagram to represent the current operation of the pump based on the monitored suction pressure and torque may comprise:

- choosing, for each monitored suction pressure value and rotational speed value, the minimum torque diagram having the next lower suction pressure value and the next higher rotational speed value.

Instead of mapping a plurality of minimum torque diagrams for different combinations of suction pressure and rotational speed values and defining the minimum torque limit as a function of differential pressure, it is possible map a plurality of minimum torque diagrams for different combinations of other operational parameters, e.g. the combination suction pressure and differential pressure. Then the mapped minimum torque diagrams can be construed to define the minimum torque limit as a function of a different variable than differential pressure, e.g. rotational speed.

According to another aspect, the invention relates to a system for pumping a fluid comprising:

- a pump comprising a suction side and a discharge side;
- a motor for driving the pump, which motor is drivingly connected to the pump via a shaft;
- a recirculation conduit providing a fluid path for the fluid from the discharge side to the suction side of the pump;
- a control valve controlling the flow of the fluid through the recirculation conduit;
- a first sensor device adapted to monitor an operational parameter of the pump; and
- a second sensor device adapted to monitor or estimate the torque of the pump;

wherein the system comprises:

- a control unit in which is stored a plurality of minimum torque diagrams for the pump, wherein each minimum torque diagram identifies the minimum allowable torque of the pump as a function of said operational parameter of the pump;

which control unit configured to:

identify, from said plurality of minimum torque diagrams, the minimum torque diagram best representing the current operation of the pump;

monitor said operational parameter of the pump and, from the minimum torque diagram best representing the current operation of the pump, identify a minimum allowable torque value corresponding to a monitored value of said operational parameter of the pump;

monitor the torque of the pump and compare a monitored torque value with the identified minimum allowable torque value; and regulate the control valve such that the monitored torque value does not fall below the minimum allowable torque value.

In the system, said operational parameter of the pump may be the differential pressure over the pump, and said monitored value of said operational parameter of the pump may be a monitored differential pressure value of the pump.

The control unit may also be configured to:

monitor suction pressure and rotational speed of the pump; and identify, at predetermined points in time, the minimum torque diagram of said plurality of minimum torque diagrams which best corresponds to the monitored suction pressure and rotational speed values.

In the following, embodiments of the invention will be disclosed in more detail with reference to the attached drawings.

DETAILED DESCRIPTION OF THE INVENTION

Figure 3:
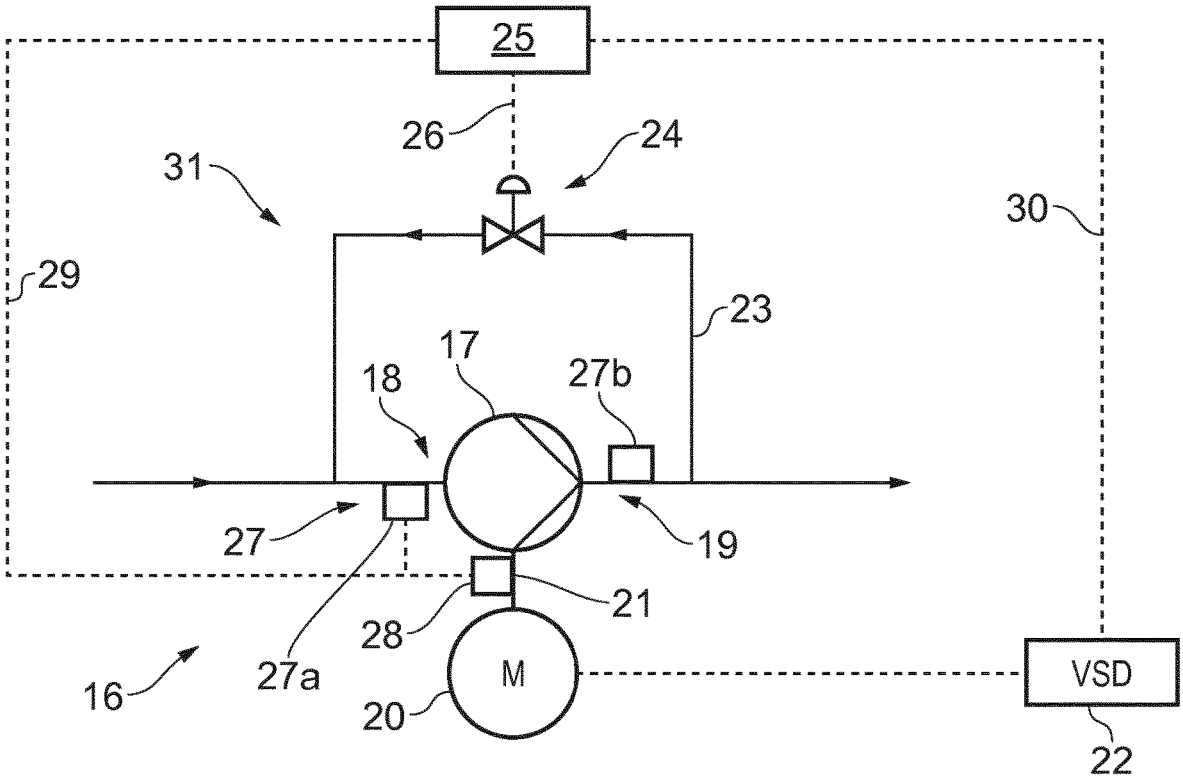
FIG. 3 shows a hydrocarbon fluid pumping system according to an embodiment of the invention.

According one embodiment, the method according to the invention is implemented in a subsea hydrocarbon fluid pumping system 16 as shown in FIG. 3. The system comprises a pump 17 having a suction side 18 and a discharge side 19. The pump 17 may advantageously be a helicoaxial (HAP) or centrifugal type pump. The system 16 further comprises an electrical motor 20 for driving the pump 17 via a shaft 21. The motor 20 may be a variable speed motor which is controlled by a variable speed drive, VSD 22. The system 1 also comprises a recirculation loop 31 for recirculating hydrocarbon fluid from the discharge side 19 to the suction side 18 of the pump 17. The recirculation loop 31 comprises a recirculation conduit 23 and a control valve 24 controlling the flow of the hydrocarbon fluid through the recirculation conduit 23. The system further comprises a control unit 25 providing control signals for the control valve 24 via a signal conduit 26.

In order to monitor or estimate a parameter indicative of the differential pressure DP across the pump 17, the system 16 comprises a first measuring or sensor device 27. This sensor device 27 may typically comprise pressure transmitters 27*a*, 27*b* arranged upstream and downstream of the pump 17.

Also, in order to monitor or estimate a parameter indicative of the torque of the pump, the system 16 comprises a second measuring or sensor device 28. The second sensor device 28 may be a torque sensor arranged to monitor the torque acting on the shaft 21 since the most accurate parameter value is obtained by measuring the pump torque directly at the shaft 21.

The monitored parameter values are conveyed from the sensor devices 27, 28 to the control unit 25 via signal conduit 29.

In the following, a method of operating a subsea hydrocarbon fluid pumping system, e.g. the subsea hydrocarbon fluid pumping system 16 shown in FIG. 3, will be discussed with reference to FIGS. 4 to 10.

Generally, the method comprises the steps of:

i) prior to pumping the hydrocarbon fluid, mapping a plurality of minimum torque diagrams for the pump; and ii) during pumping of the hydrocarbon fluid, identifying which of the minimum torque diagrams best corresponds to the current operation of the pump and regulating operation of the pump based on that minimum torque curve.

The step of mapping the plurality of minimum torque diagrams may be performed once prior to commissioning the pumping system, whereas the steps of identifying the appropriate minimum torque diagram and regulating operation of the pump based in that minimum torque diagram is performed continuously or intermittently during operation of the pumping system.

For mapping the plurality of minimum torque diagrams, pump data provided by the pump manufacturer may be utilised. For example, a pump map showing the minimum flow limit given in terms of total actual flow rate and differential pressure is usually provided by the pump manufacturer. Also, pump speed and power at the pump shaft is usually provided by the pump manufacturer for different mapping points of the pump. This information can be utilised to calculate the torque limit for the pump at different operating points.

Figure 1:
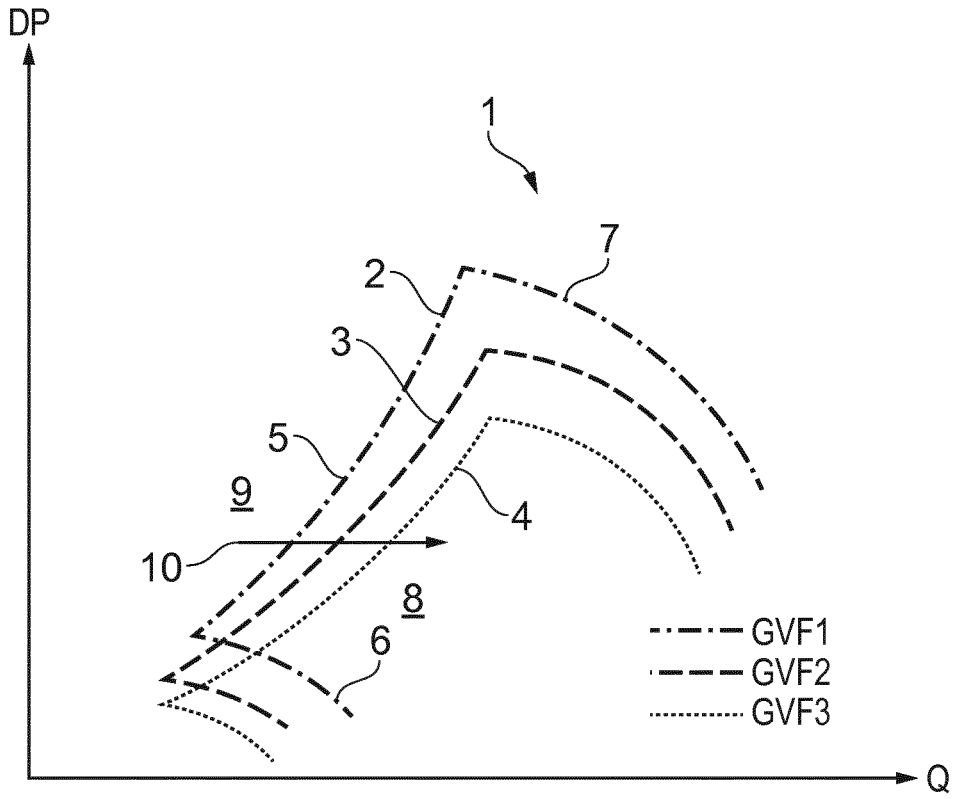
FIG. 1 (Prior Art)
FIG. 1 shows a DP-Q diagram conventionally used to illustrate the operational range of a pump in a fluid pumping system.
Figure 2:
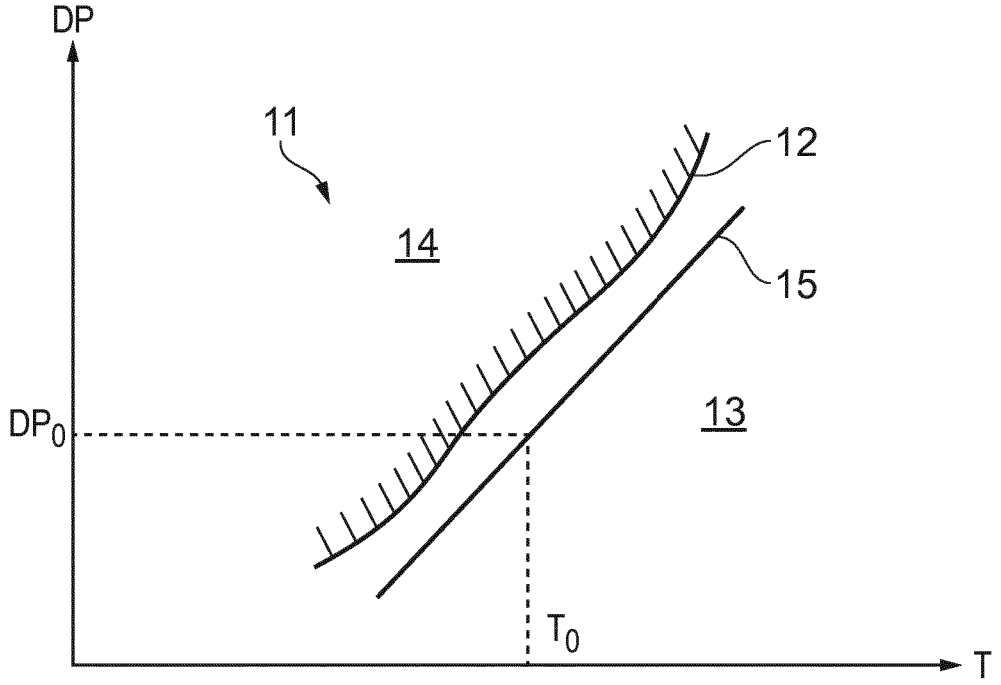
FIG. 2 (Prior Art)
FIG. 2 shows a DP-Torque diagram used to illustrate the operational range of a pump in a fluid pumping system.
Figure 4:
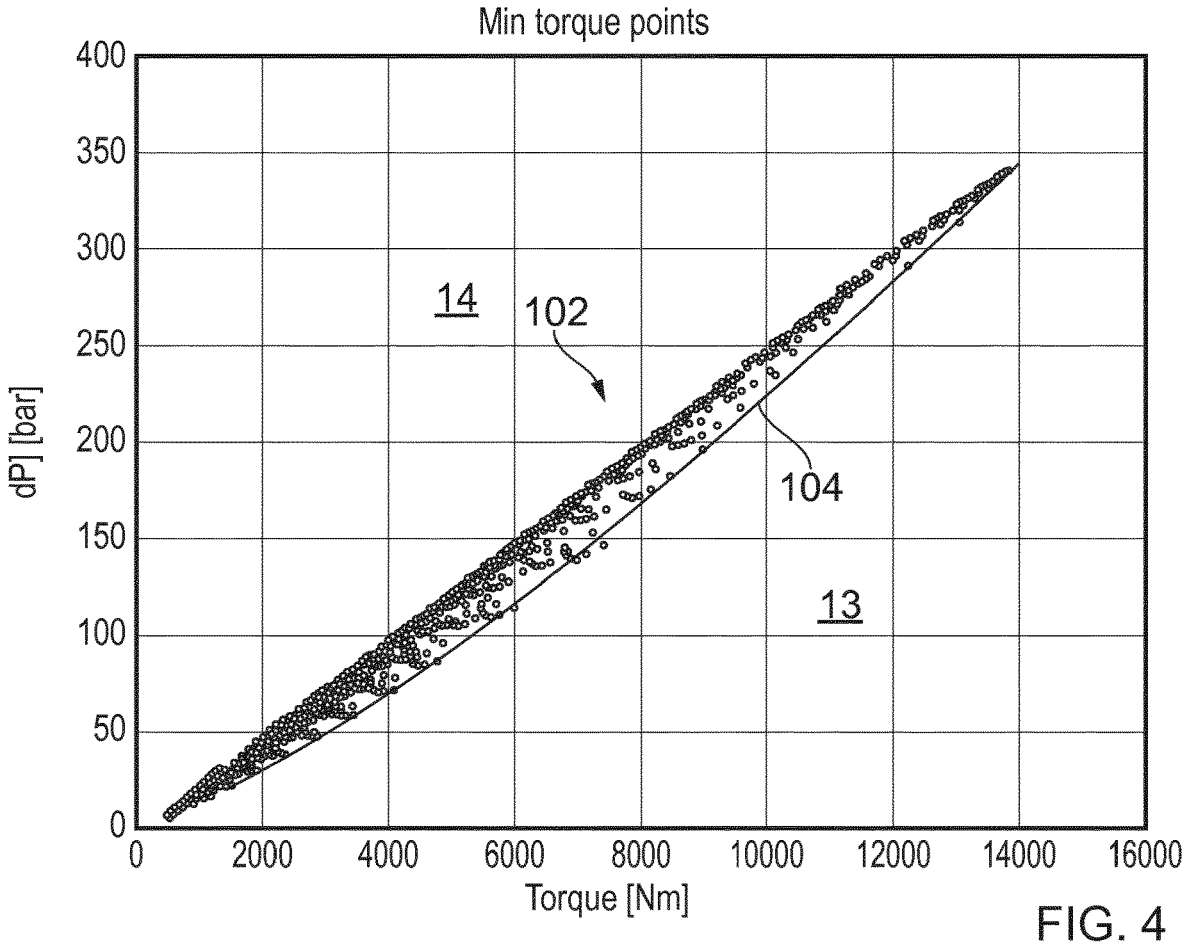
FIG. 4 shows a DP-Torque diagram illustrating mapping points and a pump limit characteristics curve established based on the mapping points.

FIG. 4 shows mapping points 102 for a pump plotted in a DP-T diagram, i.e. in a diagram where differential pressure across the pump, DP, is mapped as a function of the pump torque T for different combinations of suction pressure, rotational speed and GVF. The plotted mapping points 102 define a permissible operating region 13 and an impermissible operating region 14 of the pump, and curve 104 represents a minimum torque curve established for these mapping points, i.e. a torque curve defining an operating envelope of the pump based on the mapping points 102 in the same way as the previously discussed pump operation curve 15 (see FIG. 2).

The mapping points 102 may be established based on a pump map provided by the manufacturer in which the minimum flow limit for the pump is given in terms of total actual flow rate through the pump and differential pressure across the pump. Additionally, for each mapping point 102, the rotational speed of the pump and power at the pump shaft is given by the pump manufacturer, which is used to calculate the torque of the pump at that mapping point, thus allowing the mapping points to be plotted in a DP-T diagram, as is shown in FIG. 4.

Each point on the curve 104 is, as described above, associated with a flow rate value and a differential pressure value. Thus, for the points located directly on the curve 104 the flow rate and the differential pressure associated with each point allows the points on the curve 104 to be plotted in a flow rate/differential pressure diagram, as is shown in FIG. 5.

Figure 5:
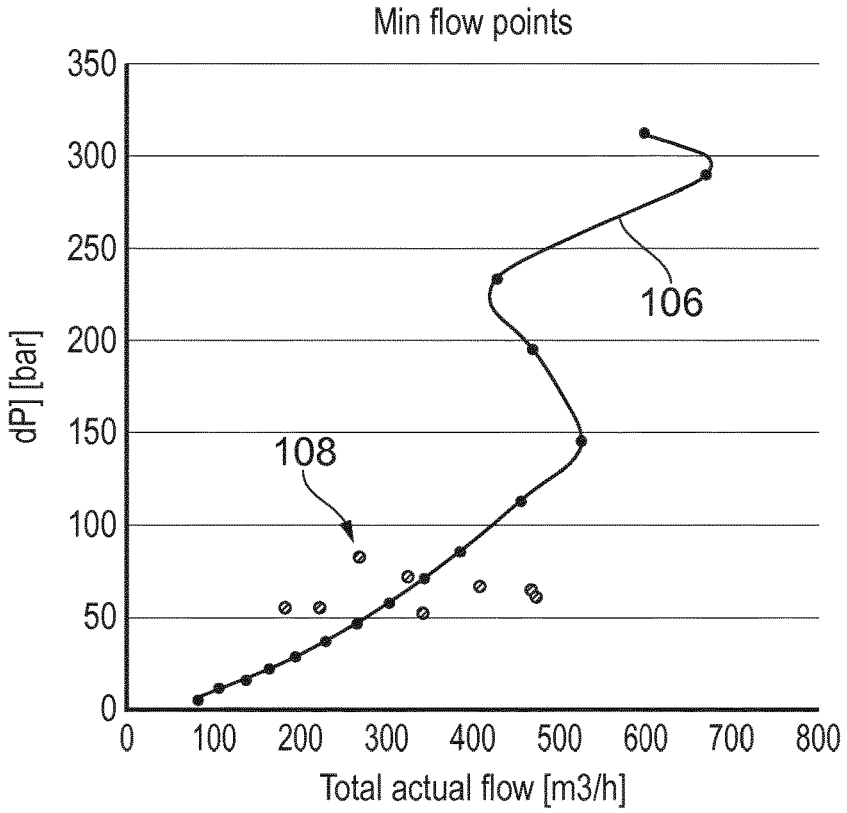
FIG. 5 shows the pump limit characteristics curve of FIG. 4 replotted in the flow domain.

FIG. 5 shows the minimum torque curve 104 of FIG. 4 replotted as a minimum flow curve 106 in the flow domain, i.e. in a diagram where the differential pressure across the pump, DP, is plotted as a function of the flow rate of the pump. FIG. 5 also shows some operating points 108 of the pump. As is evident from FIG. 5, some of the operating points 108 are located outside of the operating envelope of the pump, i.e. on the left-hand side of the minimum flow curve 106. When such operating points are detected by the pumping system, the system will recirculate fluid through the recirculation loop in order to protect the pump. Consequently, having no fluid flow and GVF measurements and relying solely on the minimum torque curve 104 for protecting the pump may, for some operating conditions, result in unnecessary recirculation through the recirculation loop of the pumping system.

According to the invention, this is avoided by regulating the pump not based on the "global" minimum torque curve 104, but on a plurality of "local" minimum torque curves and, consequently, the method according to the invention comprises the step of mapping a plurality of such "local" minimum torque curves for the pump.

This mapping of the plurality of minimum torque curves will be described in more detail in the following with reference to FIGS. 7 to 10.

Generally, for each of said plurality of minimum torque curves, the method comprises the sub-steps of:

- for a predetermined suction pressure value and a predetermined rotational speed value, establishing a plurality of mapping points by mapping differential pressure across the pump as a function of torque of the pump for different gas-volume fraction (GVF) values, and
- establishing the minimum torque curves from said mapping points by interpolating between the mapping points.

Figure 6:
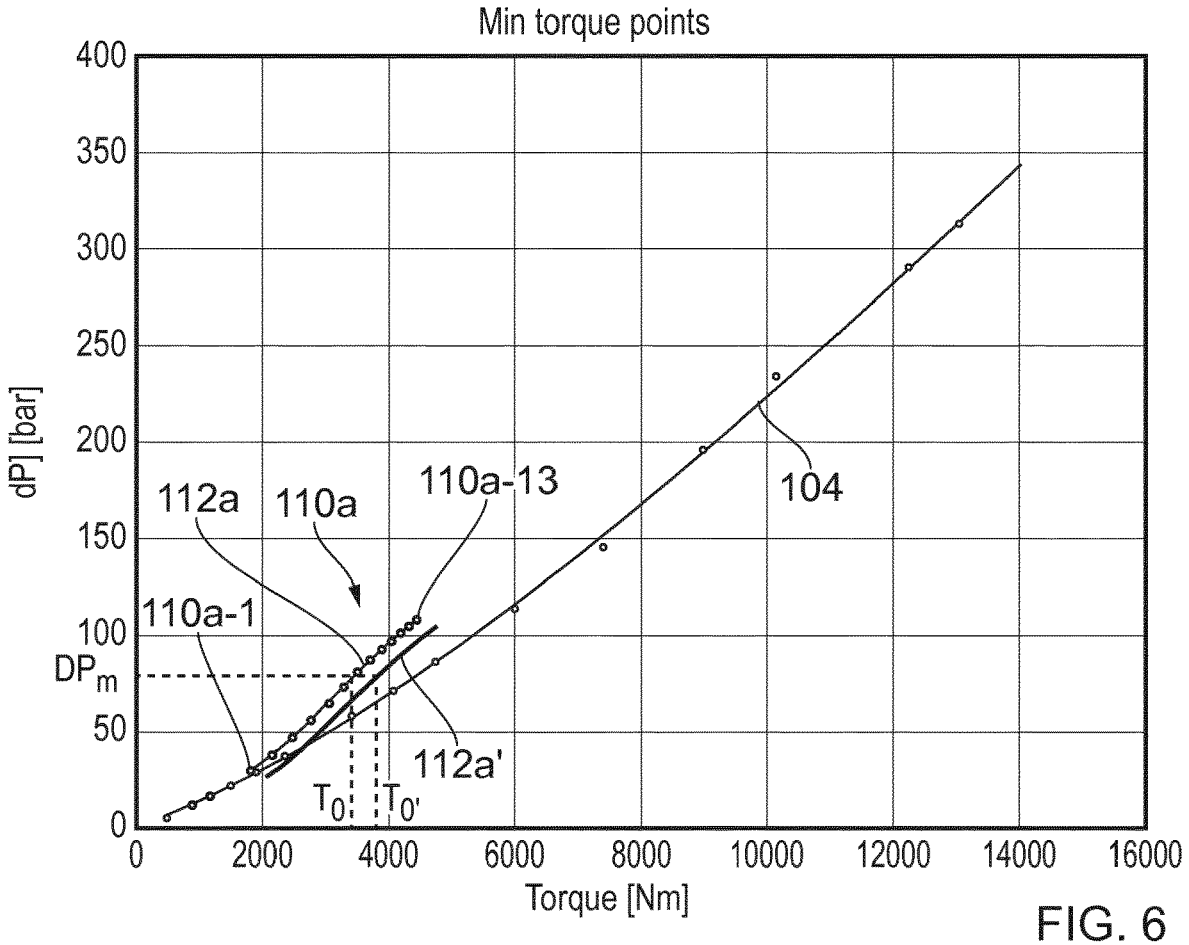
FIG. 6 shows DP-Torque diagram for a subset of the mapping points of FIG. 4.

These sub-steps are illustrated in FIG. 6, in which the minimum torque curve 104 previously discussed in relation to FIG. 4 is shown. As previously discussed, the minimum torque curve 104 is established based on a wide range of mapping points 102 provided by the pump manufacturer (see FIG. 4), i.e. a wide range of combinations of suction pressure, rotational speed and gas-volume fraction values.

As previously discussed, the minimum torque curve 104 is a "global" minimum torque curve which is valid for a wide range of operation condition of the pump, but which may result in unnecessary recirculation for some combinations of suction pressure, rotational speed and GVF values.

According to the present invention, however, a plurality of "local" minimum torque curves are established, wherein each "local" minimum torque curve is established for a limited range of suction pressure and rotational speed values. This is illustrated in FIG. 6, where 13 mapping points 110*a* for a suction pressure value of 30 bar, a rotational speed value of 2750 rpm and 13 different GVF values are shown. Consequently, the mapping points 110*a* are a subset of the mapping points 102 and are identified by a predetermined suction pressure value and a predetermined rotational speed value (i.e. 30 bar and 2750 rpm in the present case).

In particular, in FIG. 6 mapping points for suction pressure=30 bar, rotational speed=2750 rpm and 13 different GVF values, 5%, 10%, 15%, . . . 65%, are plotted, where reference numeral 110*a*-1 indicates the mapping point for which GVF=5% and reference numeral 110*a*-13 indicates the mapping point for which GVF=65%.

From the mapping points 110*a*, a "local" minimum torque curve 112*a* is established by interpolating between the mapping points 110*a*, e.g. using polynomial regression.

For operating conditions where the pump operates at or close to a suction pressure of 30 bar and a rotational speed of 2750 rpm, the minimum torque curve 112*a* will provide a more accurate minimum torque curve than the "global" minimum torque curve 104. In the pumping system this can be exploited in order to avoid unnecessary recirculation through the recirculation loop 31 (see FIG. 3).

Figure 7:
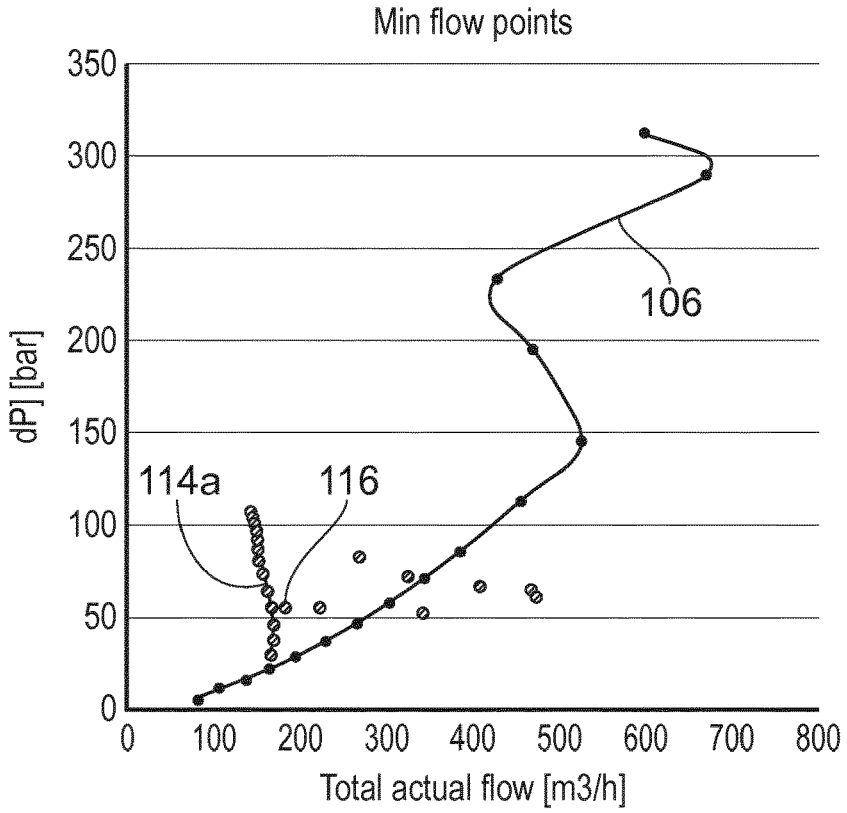
FIGS. 7 to 10 show DP-Q diagrams for different subset of the mapping points of FIG. 4.

This is illustrated in FIG. 7 which shows the minimum torque curve 112*a* replotted in the flow domain as minimum flow curve 114*a*. Also shown in FIG. 7 is an operating point 116 for a suction pressure value of 32.6 bar and a rotational speed value of 2513 rpm. As is evident from FIG. 7, operating point 116 lies outside of the operating envelope defined by minimum flow curve 106 but inside the operating envelope defined by minimum flow curve 114*a*. Consequently, whereas using the "global" minimum flow curve 106 as a basis for regulating the pump would bring the pumping system into recirculation at operation conditions defined by operating point 116, such recirculation is avoided if the "local" minimum flow curve 114*a* is used as a basis for regulating the pump at this particular operating condition (i.e. a suction pressure value of 32.6 bar and a rotational speed value of 2513 rpm).

Figure 8:
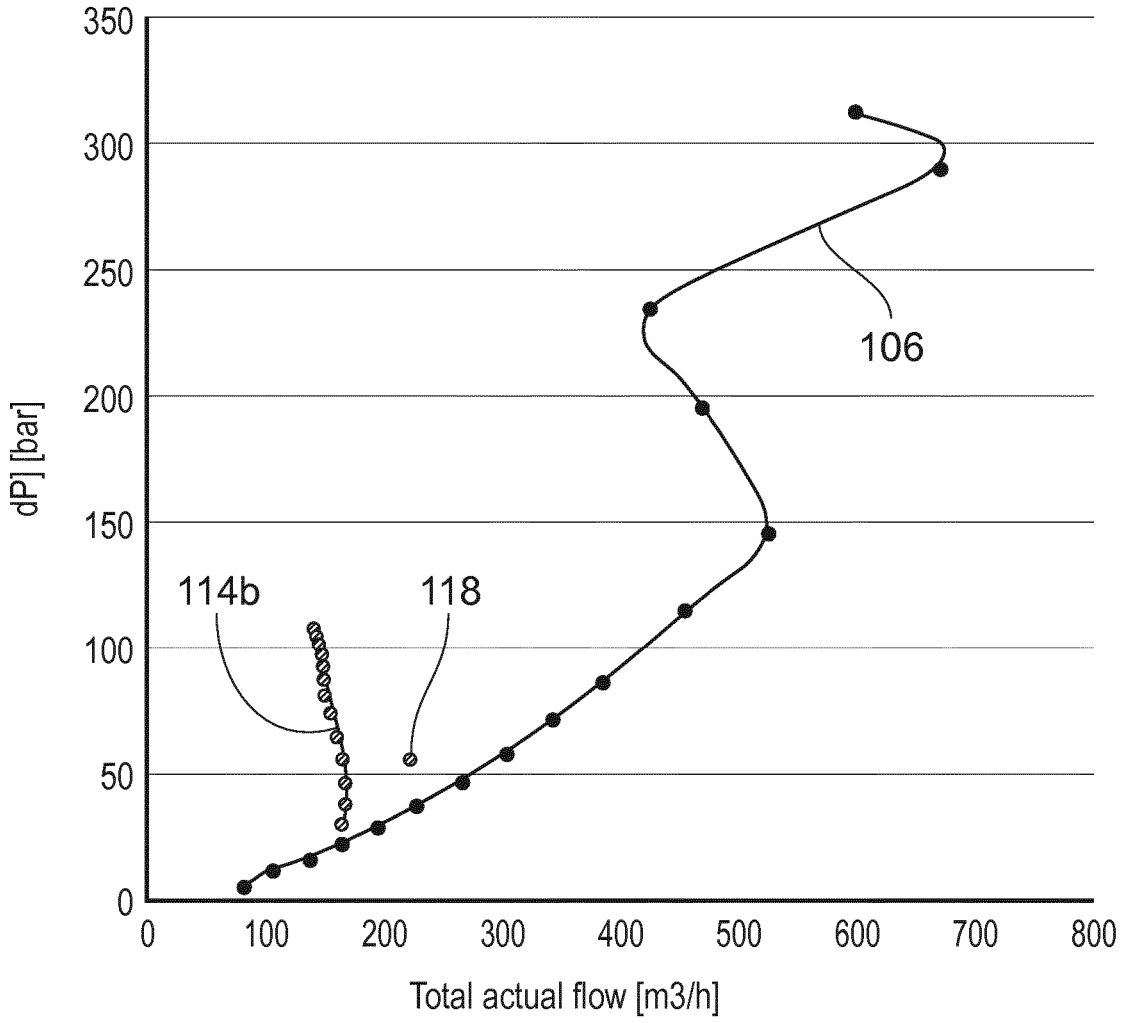
Figure 9:
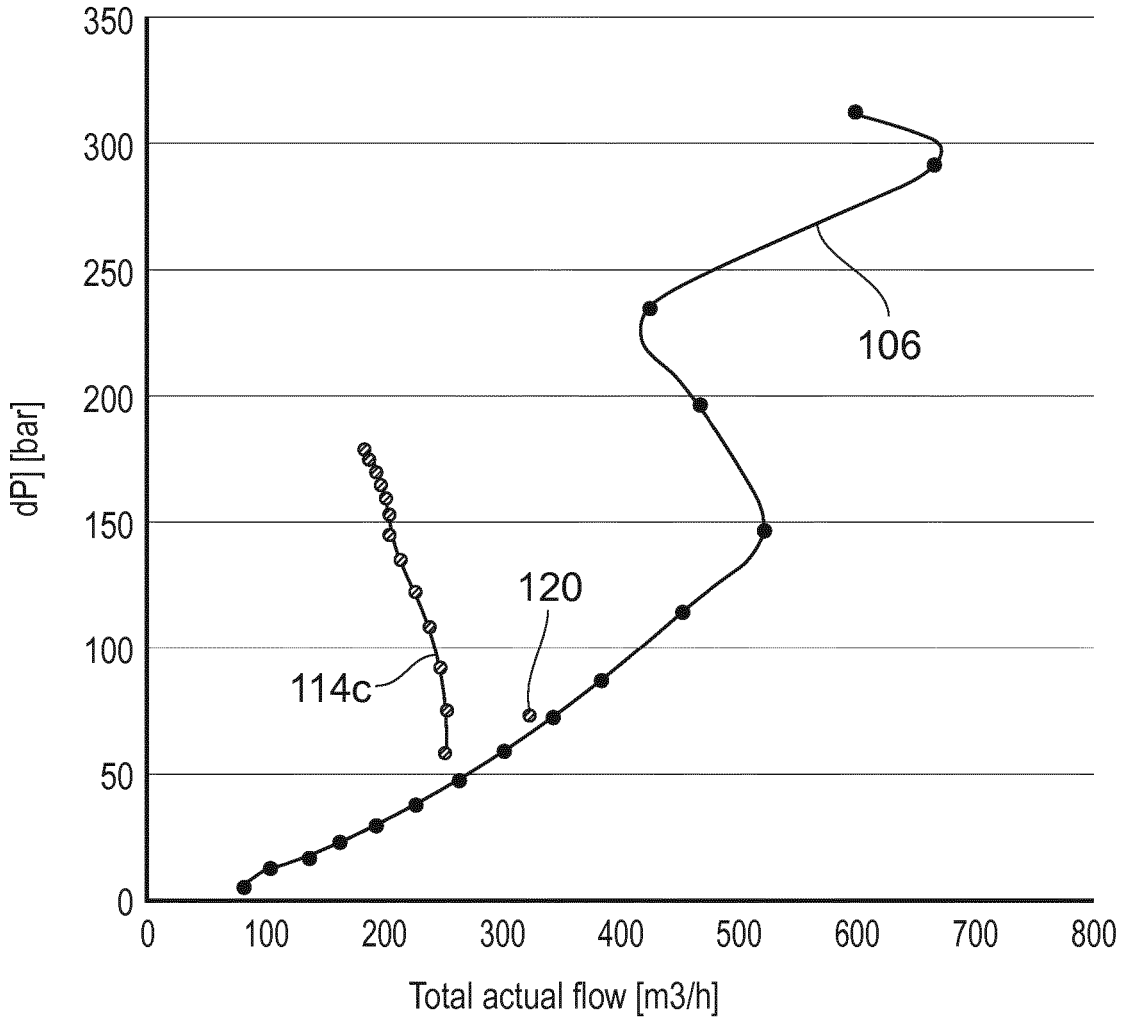
Figure 10:
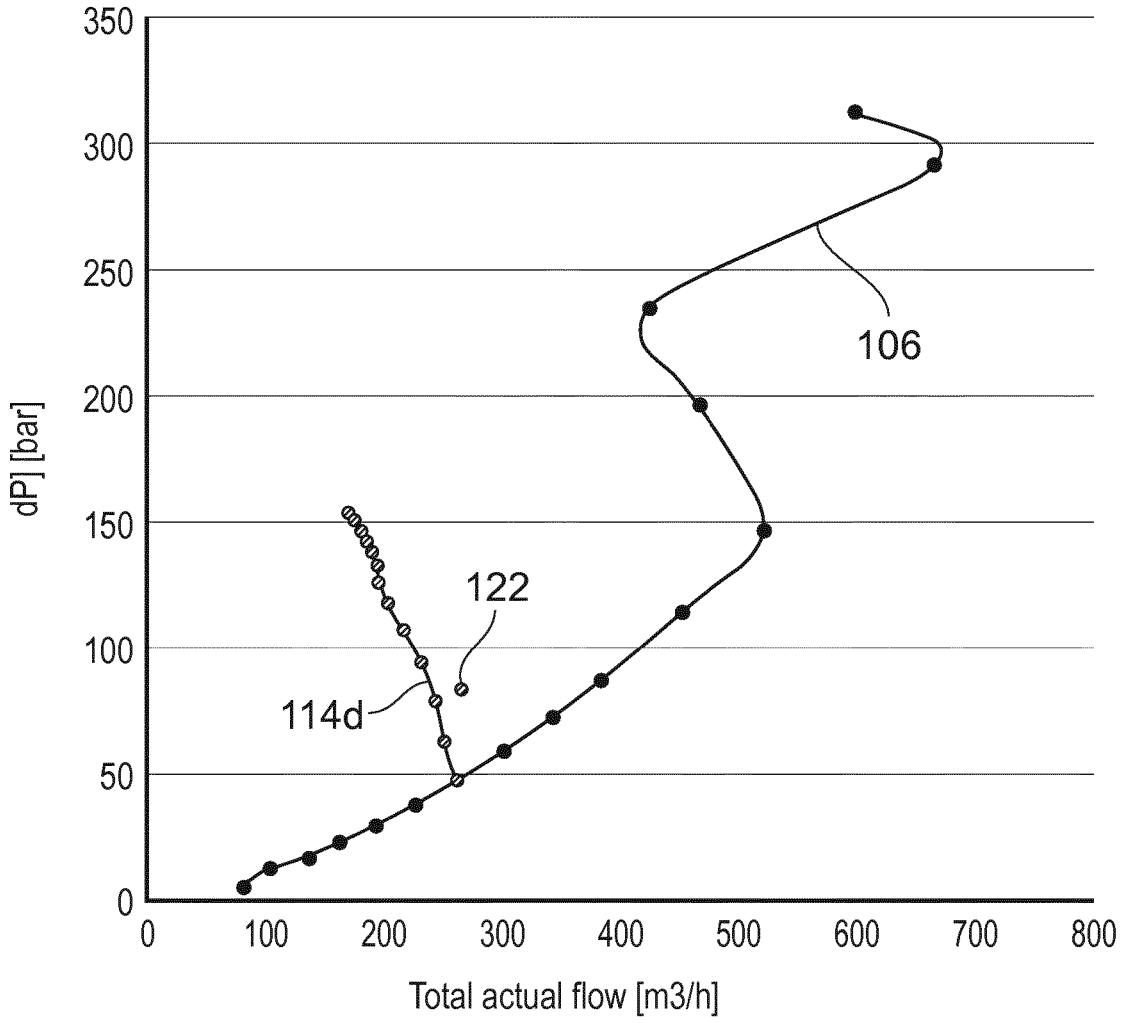

FIGS. 8 to 10 show corresponding "local" minimum flow curves for other combinations of suction pressure and rotational speed values.

FIG. 8 shows a minimum flow curve 114*b* established for a suction pressure value of 35 bar and a rotational speed value of 2750 rpm. Also shown in FIG. 8 is an operating point 118 for a suction pressure value of 39.2 bar and a rotational speed value of 2728 rpm.

FIG. 9 shows a minimum flow curve 114*c* established for a suction pressure value of 25 bar and a rotational speed value of 3250 rpm. Also shown in FIG. 9 is an operating point 120 for a suction pressure value of 28.3 bar and a rotational speed value of 3074 rpm.

FIG. 10 shows a minimum flow curve 114*d* established for a suction pressure value of 35 bar and a rotational speed value of 3500 rpm. Also shown in FIG. 10 is an operating point 122 for a suction pressure value of 39.4 bar and a rotational speed value of 3390 rpm.

As is evident from FIGS. 8 to 10, operating points 118, 120 and 122 lie outside of the operating envelope defined by the "global" minimum flow curve 106 but inside the operating envelope of the "local" minimum flow curve 114*b*, 114*c* and 114*d*, respectively. As is also evident from FIGS. 8 to 10, an operating point which lie inside the envelope of an associated "local" minimum flow curve may not necessarily lie inside the envelope of a less associated "local" minimum flow curve.

Generally, the mapping points used to establish the "local" minimum torque curves are established at predetermined suction pressure and rotational speed values within the suction pressure range and the rotational speed range the pump is projected to operate. For example, for a pump that is projected to operate within the ranges of:

1 bar≤suction pressure≤140 bar 1500 rpm≤rotational speed≤4800 rpm a minimum torque curve may be established for every 10 bar suction pressure and every 250 rpm rotational speed. This will yield 14 suction pressure values (10, 20, 30, . . . 140 bar) and 15 rotational speed values (1500, 1750, 2000, . . . 5000 rpm), thus resulting in a total of 14×15=210 minimum torque curves.

However, the mapping resolution may vary within the ranges in that the minimum torque curves may be established relatively close to each other in the most likely operating region of the pump and more sparsely outside of the same. For example, within the most likely operating range of the suction pressure, e.g. within the range of 30 bar≤suction pressure≤80 bar, "local" minimum torque curves may be established every 10 bar, whereas outside of this range, "local" minimum torque curves may be established less frequently, e.g. every 15 or 20 bar. Also, within the most likely operating range of the rotational speed, e.g. within the range of 2500 rpm≤rotational speed≤3500 rpm, "local" minimum torque curves may be established every 250 rpm, or at even closer intervals, whereas outside of this range, "local" minimum torque curves may be established less frequently, e.g. every 500 rpm. In this way, the number and the density of the mapping points and the resulting minimum torque curves may vary throughout the projected operational ranges of the pump and can thus be adjusted to suit individual pumping applications.

For each minimum torque curve, a mapping point may be established for every 5% GVF. However, due to nonlinearities at high GVF values, it may be sufficient to establish mapping points at GVF=5%, 10%, 15%, . . . , 60% and 65%. For example, in FIG. 6 the lowermost mapping point 110*a*-1 maps the differential pressure and the torque for suction pressure=30 bar, rotational speed=2750 rpm and GVF=5%, and the uppermost mapping point 110*a*-13 maps the differential pressure and the torque for suction pressure=30 bar, rotational speed=2750 rpm and GVF=65%. The same 13 GVF values have been used to map the "local" minimum flow curves 114*b*-114*d* shown in FIGS. 8-10. However, depending on the pumping application, mapping points may be established for the full range of 0-100% GVF, or for another subset of GVF values.

Once established, the minimum torque curves are stored in the pumping system, e.g. in the control unit 25 (see FIG. 3). Consequently, when the pumping system is put into operation, the plurality of minimum torques curves will be stored in the pumping system, where each minimum torque curve represents a unique combination of suction pressure and rotational speed.

It is to be understood, however, that the minimum torque curves do not have to be stored in the pumping system as curves per se but may be stored as coordinates representing the torque curves. Such coordinates may for example be stored in a look-up table in the pumping system.

When the pumping system is in operation, a parameter representing the suction pressure of the pump and a parameter representing the rotational speed of the pump are monitored to establish the current operating point of the pump. This monitoring can be continuous or intermittent. For example, the parameters may be sampled at a sampling frequency which is within the range of 1-100 Hz, thus updating the operating point of the pump every 1-0.01 second.

For every operation point, a minimum torque curve best representing the operation point is chosen from the stored plurality stored minimum torque curves to be used for regulating the pump.

The step of establishing the operation point of the pump during a pumping operation may comprise the sub-steps of:

retrieving a suction pressure value from the pressure transmitter 27*a* arranged upstream of the pump 17; and retrieving a rotational speed value from the VSD 22.

The step of establishing which of the stored plurality of minimum torque curves to be used to regulate the pump may comprise the sub-step of:

using the retrieved suction pressure and rotational speed values to select the minimum torque curve from said plurality of the minimum torque curves best representing the current operating point.

Within a given range of suction pressure values, the lowest suction pressure value is the most conservative and may therefore be used to represent the range. Therefore, for an operating point having a suction pressure value of, for example, 32.6 bar, the minimum torque curve defined for the next lower suction pressure value, e.g. 30 bar, may be considered to best represent the operating point against which the pump is to be regulated.

Within a given range of rotational speed values, the higher rotational speed value is the most conservative and may therefore be used to represent the range. Therefore, for an operating point having a rotational speed value of, for example, 2513 rpm, the minimum torque curve defined for the next higher rotational speed value, e.g. 2750 rpm, may be considered to best represent the operating point against which the pump is to be regulated.

Consequently, following the example above, for an operating point defined by the values differential pressure=32.6 bar, rotational speed=2513 rpm, the minimum torque curve established for differential pressure=30 bar, rotational speed=2750 rpm may be chosen to represent the operating point against which the pump is to be regulated.

When the minimum torque curve best representing the current operating point has been chosen, this minimum torque curve is used to protect the pump. This is achieved by monitoring the differential pressure over the pump and the torque of the pump. Using the monitored differential pressure value $DP_m$, the minimum flow curve is used to identify the corresponding torque value $T_0$, as is illustrated in FIG. 6, which torque value $T_0$ is then used as a minimum allowable torque value for the pump. The pumping system is then regulated to keep the monitored torque value $T_m$ from undercutting the minimum allowable torque value $T_0$.

For example, a control valve control signal $S_{valve}$ may be calculated based on the difference between the monitored torque value $T_m$ and the minimum allowable torque value $T_0$, and the control valve control signal $S_{valve}$ is then used to regulate the control valve 24 such that the monitored torque value $T_m$ does not fall below the minimum allowable torque value $T_0$. In particular, the control valve control signal $S_{valve}$ may be set to open the control valve 24 when the monitored torque value $T_m$ approaches the minimum allowable torque value $T_0$, thus preventing the pump torque from undercutting the minimum allowable torque value $T_0$. For example, for each minimum torque curve 112*a*, a control curve 112*a*' may be established at a predetermined distance from the minimum torque curve 112*a* on the permissible operating side of the minimum torque curve 112*a* (see FIG. 6), which minimum torque curve 112*a*' identifies a minimum torque value $T_0'$ (which is larger than the minimum allowable torque value $T_0$) at which the pumping system should trigger the opening of the control valve 24. The minimum torque value $T_0'$ may thus act as a setpoint for the desired opening of the control valve 24.

Referring to the pumping system 16 shown in FIG. 3, the differential pressure over the pump 17 may be monitored using the first measuring or sensor device 27. In particular, the differential pressure may be calculated from pressure values retrieved from pressure transmitter 27*a* positioned upstream of the pump 17 and pressure transmitter 27*b* positioned downstream the pump 17.

The torque of the pump 17 may be monitored using the second measuring or sensor device 28 positioned at the pump shaft 21.

In subsea applications, however, measuring the pump torque directly at the shaft 21 may not be a viable option since surface signal conduits may have bandwidth ratings ruling out efficient transfer of the torque signal. In subsea pumping systems, the VSD is generally more accessible than the pump-motor assembly since the VSD is normally positioned topside, i.e. above sea level. Also, the signals of the VSD 22 can be sampled with a relatively high sampling frequency which makes it possible to realise a responsive control system. Therefore, in some applications it may be advantageous to sample the parameter indicative of the torque from the VSD 22. This is typically done by retrieving the power output from the VSD 22 and estimating losses between the VSD 22 and the pump shaft 21, which losses may include but need not be limited to losses in filters, cables/umbilical, motor windings etc. The resulting power value is then used to calculate the torque acting on the shaft 21. Some of the losses may be estimated in the VSD 22 and incorporated in the power output from the shaft 21, in which case the loss calculation may be adjusted accordingly.

If the parameter indicative of the torque is sampled from the VSD 22, the monitored second parameter values may be conveyed from the VSD 22 to the control unit 25 via signal conduit 30.

The monitored differential pressure and torque values are sampled with a sampling frequency which is sufficiently high to provide a responsive control system. Typically, the sampling frequency of the parameters indicative of the differential pressure across the pump and the torque may be within the range of 1 to 100 Hz.

However, the parameters indicative of the differential pressure across the pump and the torque may be sampled using different sampling frequencies. For example, the differential pressure over the pump may vary relatively slowly due to large volumes of hydrocarbon fluid upstream and downstream of the pump. However, the gas volume fraction and/or the density of the hydrocarbon fluid may change quickly, e.g. due to gas and/or liquid slugs in the system. Consequently, the pump torque may also change relatively quickly. Therefore, in order to enable the system to react quickly to a change in the gas volume fraction and/or the density of the fluid, it may be advantageous to sample the torque using a higher sampling frequency than when sampling the differential pressure.

In the preceding description, various aspects of the invention have been described with reference to the illustrative embodiment. For purposes of explanation, specific numbers, systems and configurations were set forth in order to provide a thorough understanding of the invention and its workings. However, this description is not intended to be construed in a limiting sense. The scope of the claims also cover variations, modifications and alternatives of the illustrative embodiment.

The invention claimed is:

1. A method of operating a system for pumping a fluid, the system comprising:

a pump comprising a suction side and a discharge side;

a motor for driving the pump, the motor being drivingly connected to the pump via a shaft;

a recirculation conduit providing a fluid path for the fluid from the discharge side to the suction side of the pump; and a control valve controlling the flow of the fluid through the recirculation conduit;

wherein the method comprises the steps of:

mapping a plurality of minimum torque curves for the pump, wherein each minimum torque curve identifies a minimum allowable torque of the pump as a function of an operational parameter of the pump;

from said plurality of minimum torque curves, identifying a minimum torque curve best representing the current operation of the pump;

monitoring said operational parameter of the pump and, from the minimum torque curve best representing the current operation of the pump, identifying a minimum allowable torque value ($T_0$) corresponding to a monitored value ($DP_m$) of said operational parameter of the pump;

monitoring a torque of the pump and comparing the monitored torque value ($T_m$) with the identified minimum allowable torque value ($T_0$); and regulating the control valve such that the monitored torque value ($T_m$) does not fall below the minimum allowable torque value ($T_0$).

2. The method according to claim 1, wherein said operational parameter of the pump is a differential pressure over the pump and said monitored value of said operational parameter of the pump is a monitored differential pressure value ($DP_m$) of the pump.

3. The method according to claim 1, wherein each minimum torque curve represents a unique combination of a suction pressure and a rotational speed of the pump.

4. The method according to claim 3, wherein each minimum torque curve defines mapping points for a predetermined suction pressure value and a predetermined rotational speed value of the pump.

5. The method according to claim 4, wherein the step of mapping each minimum torque curve comprises the sub-step of:

for the predetermined suction pressure value and the predetermined rotational speed value, defining said plurality of mapping points by mapping differential pressure over the pump as a function of torque of the pump for different gas-volume fraction (GVF) values.

6. The method according to claim 5, wherein the step of mapping each minimum torque curve comprises the sub-step of:

establishing a minimum torque curve from said mapping points by interpolating between the mapping points.

7. The method according to claim 5, wherein said step of identifying the minimum torque curve best representing the current operation of the pump comprises:

monitoring suction pressure and rotational speed of the pump; and choosing the minimum torque curve to represent the current operation of the pump based on the monitored suction pressure and torque.

8. The method according to claim 7, wherein said step of choosing the minimum torque curve to represent the current operation of the pump based on the monitored suction pressure and torque comprises:

choosing, for each monitored suction pressure value and rotational speed value, the minimum torque curve having the next lower suction pressure value and the next higher rotational speed value.

9. A system for pumping a fluid, comprising:

a pump comprising a suction side and a discharge side;

a motor for driving the pump, the motor being drivingly connected to the pump via a shaft;

a recirculation conduit providing a fluid path for the fluid from the discharge side to the suction side of the pump;

a control valve controlling the flow of the fluid through the recirculation conduit;

a first sensor device adapted to monitor an operational parameter of the pump;

a second sensor device adapted to monitor or estimate the torque of the pump;

a control unit in which is stored a plurality of minimum torque curves for the pump, wherein each minimum torque curve identifies a minimum allowable torque of the pump as a function of said operational parameter of the pump;

wherein the control unit is configured to:

identify, from said plurality of minimum torque curves, a minimum torque curve best representing the current operation of the pump;

monitor said operational parameter of the pump and, from the minimum torque curve best representing the current operation of the pump, identify a minimum allowable torque value ($T_0$) corresponding to a monitored value ($DP_m$) of said operational parameter of the pump;

monitor a torque of the pump and compare the monitored torque value ($T_m$) with the identified minimum allowable torque value ($T_0$); and regulate the control valve such that the monitored torque value ($T_m$) does not fall below the minimum allowable torque value ($T_0$).

10. The system according to claim 9, wherein said operational parameter of the pump is the differential pressure over the pump and said monitored value of said operational parameter of the pump is a monitored differential pressure value ($DP_m$) of the pump.

11. The system according to claim 9, wherein the control unit is adapted to:

monitor suction pressure and rotational speed of the pump; and identify, at predetermined points in time, the minimum torque curve of said plurality of minimum torque curves which best corresponds to the monitored suction pressure and rotational speed values.

* * * * *